United States Patent [19]

Walz

[11] Patent Number: 4,477,863

[45] Date of Patent: Oct. 16, 1984

[54] WORK-LIGHT

[76] Inventor: Alfred Walz, Am Kurzarm 7, D - 7830 Emmendingen, Fed. Rep. of Germany

[21] Appl. No.: 469,810

[22] Filed: Feb. 25, 1983

[30] Foreign Application Priority Data

Feb. 25, 1982 [DE] Fed. Rep. of Germany ... 8205219[U]

[51] Int. Cl.[3] ..... F21V 9/16

[52] U.S. Cl. ..... 362/84; 362/217; 362/221; 362/222; 362/223; 362/225; 362/227; 362/249; 362/250; 362/265; 362/307; 362/310; 362/311; 362/362; 362/371; 362/375; 362/421; 362/427; 362/432

[58] Field of Search ..... 362/84, 217, 221, 222, 362/223, 225, 227, 249, 250, 265, 307, 310, 311, 362, 371, 375, 421, 427, 432

[56] References Cited

U.S. PATENT DOCUMENTS 4,053,811 10/1977 Abernethy ..... 362/221
4,287,456 9/1981 Kovacik et al. ..... 362/221

*Primary Examiner*—Stephen J. Lechert, Jr.
*Attorney, Agent, or Firm*—Browdy and Neimark

[57] ABSTRACT

A work light comprising a housing; a gas discharge lamp of the fluorescent type positioned inside a portion of said housing, means defining a compartment which is an extension of said portion of said housing, and a smoothing choke and a rectifier including a voltage multiplier circuit mounted in the compartment. The compartment and the portion of the housing are aligned with each other along the longitudinal axis of the housing. An electrical power supply cable is connected to the housing in series with an electric switch, and a swivel arm is mounted on the housing, the power supply cable extending through the swivel arm.

16 Claims, 1 Drawing Figure

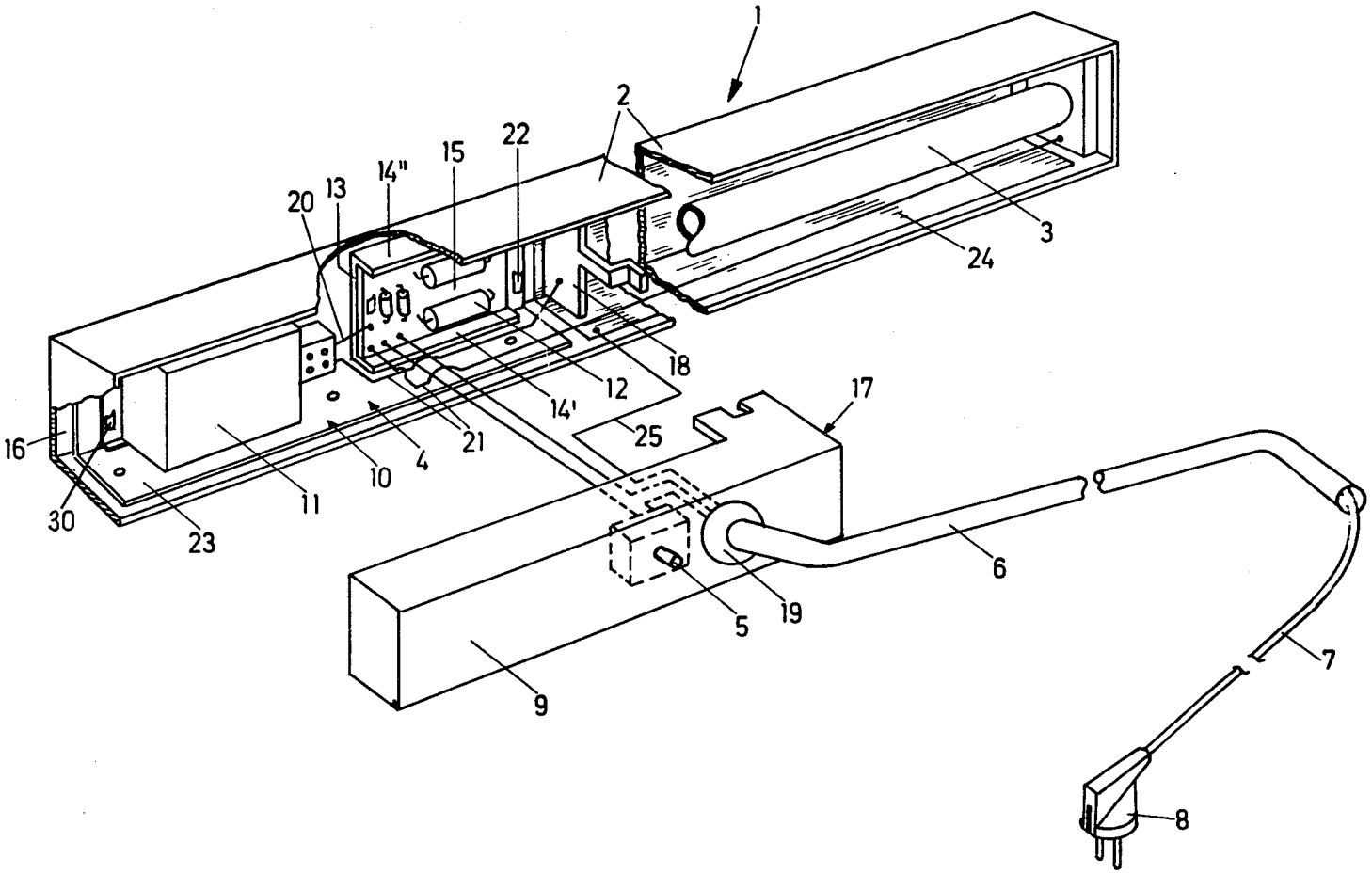
1
2
3
24
22
15
14"
13
20
16
30
23
11
10
4
21
14'
12
18
25
17
19
5
9
6
7
8

WORK-LIGHT

FIELD OF THE INVENTION

The invention relates to a work light comprising a gas discharge lamp arranged in a housing, a power processing unit, and switching mechanism as well as a swivel arm through which a power supply cable passes.

BACKGROUND OF THE INVENTION

Description of the Prior Art

Work lights of the type defined above are known, whereby the gas discharge lamp is operated on alternating current. The alternating current causes the light to flicker at substantially twice the supply frequency, which is very disturbing and in many cases fatiguing. Gas discharge lamps (fluorescent tubes) are known which contain, in the interior of the lamp, a layer of fluorescent material constructed as a storage element so that an afterglow effect is produced which partly dampens the flickering effect. The relatively thick afterglow layer, however, reduces the light output in some cases by up to 50%.

If gas discharge lamps operated on alternating current are used for room lighting, the flickering effect is less disturbing owing to the greater distance from the workplace.

It is further known to operate gas discharge lamps with high frequency voltage, for instance 35 kHz, in order to avoid flicker effects. Because of the high frequency voltage the flickering is no longer visible, however, disadvantageous biological effects are possible. For instance, X-rays could be present. It therefore becomes necessary to shield the gas discharge lamps and to provide filter elements for the supply circuits so that high frequency voltages do not cause disruptions in the supply lines.

SUMMARY OF THE INVENTION

It is an object of the present invention, to provide a work light in which the flickering effect is eliminated and several colors are reproduced as closely as possible to the colors of the daylight spectrum.

This object is achieved in general in the present invention in a work light of the kind described hereinbefore, wherein a smoothing choke and a rectifier containing a voltage multiplier circuit are arranged in a compartment formed by an extension in the cover of the housing of the gas discharge lamp.

By the arrangement according to the invention of a rectifier in the housing of the work light the gas discharge lamp can be operated with direct current. This results in a substantial increase in light yield compared with that obtained with conventional incandescent lamps in work lights or with gas discharge lamps operating with alternating current, as well as light which is free from flickering and similar to daylight in its spectral distribution. The rectifier serves as an operating and ignition device for the gas discharge lamp.

In contrast to alternating current and high frequency operation of gas discharge lamps, direct current operation requires considerably less technical effort, especially since shielding, choke and/or filter elements can be omitted.

A particularly advantageous embodiment of the invention is obtained by mounting the rectifier on a circuit panel arranged in U-shaped rails of a supporting plate. This provides for easy installation of the rectifier in the housing.

According to one advantageous embodiment of the work light of the invention, the internal walls of the housing, particularly in the region of the gas discharge lamp, are provided with a reflective metallic coating. This reflective coating serves not only to reflect the light and improve its emission through the open side of the housing but also forms a shield against biologically harmful electromagnetic fields.

According to a further preferred feature, the reflective metallic coating is connected to the power supply plug by a ground lead in the connecting cable. This ground lead (central wire) conducts away any electrostatic charge on the reflective lining.

According to a preferred embodiment of the invention, a U-shaped supporting member serving as a support and a heat sink for the heat given out by the smoothing choke and the rectifier is provided in said compartment, substantially parallel to the housing wall. In a constructionally advantageous manner the U-shaped supporting member is connected to the housing by deformed plastic rivets.

According to a further preferred feature of the invention, the cover of the housing is connected by lugs engaging apertures in the U-shaped supporting member.

According to another advantageous preferred feature of the invention, the gas discharge lamp contains a fluorescent layer and a gas emits light resembling daylight. Gas discharge lamps of this type are available commercially under the name, "True-lite".

According to a further preferred feature of the invention, two to four gas discharge lamps may be arranged geometrically parallel in pairs in the housing to increase the light output. This arrangement enables up to four gas discharge lamps to be connected electrically in series, using one and the same smoothing choke.

It is also possible to provide more than four gas discharge lamps, e.g. by arranging them in a circle inside a cylindrical housing.

Furthermore, circular gas discharge lamps can be used.

In accordance with a further advantageous embodiment of the invention, a generally known lift-out device for the gas discharge lamp is provided in the bottom of the housing in the area of the front part of the cover.

To ensure that the work light may be used in a wide variety of situations, it is advantageous to provide a ball joint for the swivel arm in the cover in known manner.

The work light according to the invention may be clamped to a table top or fixed to a wall by suitable means.

BRIEF DESCRIPTION OF THE DRAWING

Further characteristics, advantages and details of the invention are described in more detail by way of the accompanying drawing in which the sole FIGURE is a schematic representation of a preferred embodiment in perspective with some parts exploded, broken away or in cross section for the sake of clarity.

DESCRIPTION OF THE PREFERRED EMBODIMENT

The work light 1 according to the invention comprises an elongate housing 2 containing an elongate gas discharge or fluorescent lamp 3. A cover 9 serves to form and at the same time cover a compartment 10 in the housing 2. A unipolar or bipolar on-off switch 5 is arranged in the cover 9. A swivel arm 6 is connected to the cover 9 by a ball joint 19. The swivel arm 6 contains a power supply cable 7 with plug 8 connected to the switch 5. In the region of the gas discharge lamp 3, the interior of the housing 2 is provided with a reflective metallic coating 24. Reflective coating 24 serves to reflect the light of the gas discharge lamp 3 and in particular to increase the emission of light from the open underside of the housing 2. This coating also serves to shield any biologically harmful electromagnetic field capable of penetrating the housing 2. In addition, the reflective coating 24 may serve to conduct away any electrostatic discharge produced. For this purpose, the reflective coating 24 is advantageously connected to a ground lead 25 which is carried in the connecting cable 7 to be connected to a three-pin plug, indicated at 8.

A U-shaped angle plate 23 provided in the compartment 10 of the housing 2 is connected to the housing 2 by means of mushroom shaped or rivet-like projections on the housing 2 which are passed through apertures in the angle plate and subsequently deformed by heat. Mounted on the angle plate 23 are a smoothing choke 11, preferably with lugs bent over, and a supporting plate 13 with U-shaped flanges 14', 14'', which is preferably also attached by lugs turned down. A circuit panel 15 carrying a rectifier-multiplier 12 is inserted between the U-shaped flanges 14', 14''.

This rectifier-multiplier 12 is connected to the smoothing choke 11 by a lead 20 and to the gas discharge lamp 3 by a lead 21.

The cover 9 has a front wall 17 supporting a lift-out device 18 for the gas discharge lamp 3.

The arrangement according to the invention of a smoothing choke 11 as part of the series switching unit 4 electrically connected in series with the rectifier-multiplier 12 and gas discharge lamp 3 provides a space-saving, compact work light in which the gas discharge lamp 3 provides a light which is substantially free from flickering. The gas discharge lamp 3 used is preferably one which emits light similar to daylight in its spectral distribution.

The rectifier-multiplier 12 is replaceably mounted in the rails 14', 14'' but the smoothing choke 11 is preferably more permanently fixed. Particularly in the manner described, in which the smoothing choke 11 is connected to the angle plate 23 by fixing lugs 30. The supporting plate 23 also serves to conduct away heat. The present invention is not limited to the embodiment illustrated and described. It covers all further developments and modifications within the scope of the state of the art, for example with 2 or 4 gas discharge lamps 3 arranged geometrically parallel. In this modified example, the connections for the gas discharge lamps 3 are provided in the appropriate number, wherein the required leads for providing the electric connections in series are arranged in a manner not illustrated. It is also possible to provide more than 4 gas discharge lamps. For example, the gas discharge lamps may be arranged in a circle in a cylindrical housing (not shown).

The invention also includes all partial or sub-combinations of the characteristics and steps described and/or illustrated.

I claim:

1. A work light comprising a housing, a gas discharge lamp positioned inside a portion of said housing, a power supply cable connected to said housing, means defining a compartment which is an extension of said portion of said housing, and a smoothing choke and a rectifier including a voltage multiplier circuit mounted in said compartment.

2. A work light according to claim 1, wherein the rectifier is mounted on a circuit panel arranged between U-shaped flanges of a supporting plate.

3. A work light according to claim 1, wherein the internal walls of the housing are covered with a reflective metallic coating, especially in the region of the gas discharge lamp.

4. A work light according to claim 3, wherein the reflective coating is connected to a power supply plug a ground lead in the power supply cable.

5. A work light according to claim 1, wherein a U-shaped supporting member for the smoothing choke and rectifier is provided in said compartment, substantially parallel to the housing wall.

6. A work light according to claim 5, wherein the U-shaped supporting member is attached to the housing by deformed plastics rivets.

7. A work light according to claim 1, wherein the cover is connected to the U-shaped supporting member by lugs in one engaging in apertures in the other.

8. A work light according to claim 1, wherein the gas discharge lamp has a fluorescent layer emitting light corresponding to daylight, and a gas filling.

9. A work light according to claim 1, wherein two or four gas discharge lamps are arranged geometrically parallel in pairs in the housing.

10. A work light according to claim 1, wherein a lift-off device for the gas discharge lamp(s) is provided in the bottom of the housing in the region of a side wall of the cover.

11. A work light as defined in claim 1 comprising a swivel arm mounted on said housing.

12. A work light as defined in claim 1 comprising an electric switch connected in series with said power supply cable.

13. A work light as defined in claim 11, in which said swivel arm is mounted on said housing by means of a balljoint.

14. A work light as defined in claim 1 comprising a cover for said compartment.

15. A work light as defined in claim 11 in which said power supply cable extends through said swivel arm.

16. A work light as defined in claim 1 in which said compartment and said portion of said housing are aligned with each other along the longitudinal axis of said housing.

* * * * *